US005764781A

United States Patent [19]

Ding

[11] Patent Number: 5,764,781

[45] Date of Patent: Jun. 9, 1998

[54] SPEAKER AND AMPLIFIER SYSTEM

[76] Inventor: Chih-Shun Ding, 2801 S. Orchard #16, Los Angeles, Calif. 90007

[21] Appl. No.: 570,980

[22] Filed: Dec. 12, 1995

[51] Int. Cl.[6] ..... H04R 3/00

[52] U.S. Cl. ..... 381/96

[58] Field of Search ..... 381/96, 59

[56] References Cited

U.S. PATENT DOCUMENTS

| | | | |
|---|---|---|---|
| 4,118,600 | 10/1978 | Stahl | 179/1 D |
| 4,276,443 | 6/1981 | Meyers | 179/1 |
| 4,335,274 | 6/1982 | Ayers . | |
| 4,573,189 | 2/1986 | Hall | 381/96 |
| 4,980,920 | 12/1990 | Noro et al. | 381/96 |
| 5,031,221 | 7/1991 | Yokoyama | 381/96 |
| 5,086,473 | 2/1992 | Erath | 381/96 |
| 5,206,912 | 4/1993 | Noro | 381/96 |
| 5,588,065 | 12/1996 | Tanaka et al. | 381/96 |

OTHER PUBLICATIONS

K.G. Stahl, "Synthesis of loudspeaker mechanical parameters by electrical means: a new method for controlling low-frequency loudspeaker behavior" in J. Audio Eng. Soc. vol. 29, No. 9, pp. 587–596 (1981).

P.G.L. Mills and M.O.J. Hawksford, "Distortion reduction in moving-coil loudspeaker systems using current-drive technology" in J. Audio Eng. Soc. vol. 37, No. 3, pp. 129–148 (1989).

P.G.L. Mills and M.O.J. Hawksford, "Transconductance power amplifier systems for current-driven loudspeaker" in J. Audio Eng. Soc. vol. 37, No. 10, pp. 809–822 (1989).

*Primary Examiner*—Forester W. Isen
*Attorney, Agent, or Firm*—Oppedahl & Larson

[57] ABSTRACT

An improved sound reproduction system employs an amplifier system and a speaker. The system offers greatly improved bass response. The speaker provides two negative feedback signals, one indicative of the current through the speaker voice coil and a second indicative of the velocity of the speaker diaphragm. The velocity signal is provided via the first feedback path to an input of the amplifier of the amplifier system. The current signal is provided by the second feedback path through a bandpass filter to the amplifier input. The velocity measurement may be derived from a second voice coil coupled to the diaphragm, or may be derived from a piezoelectric sensor coupled thereto. The current signal may be derived from the voltage drop across a resistor placed in series with the speaker voice coil.

38 Claims, 9 Drawing Sheets

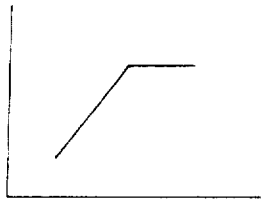
FIG. 17a
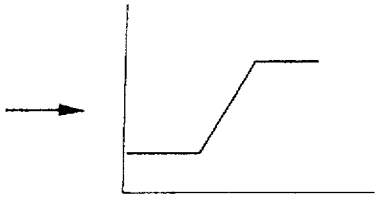
FIG. 17b
OR
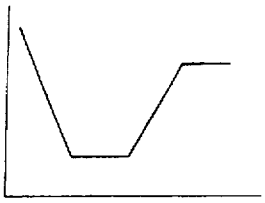
FIG. 17c
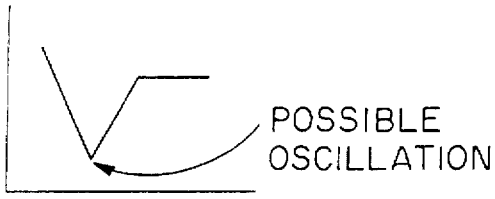
FIG. 18
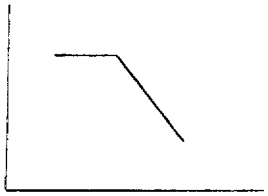
FIG. 19a
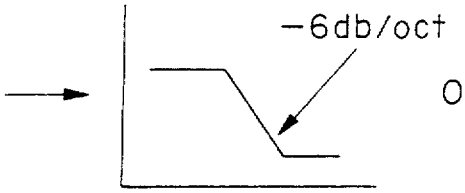
OR
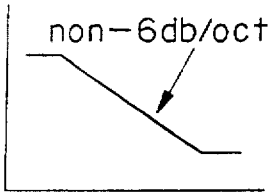
FIG. 19b
FIG. 19c
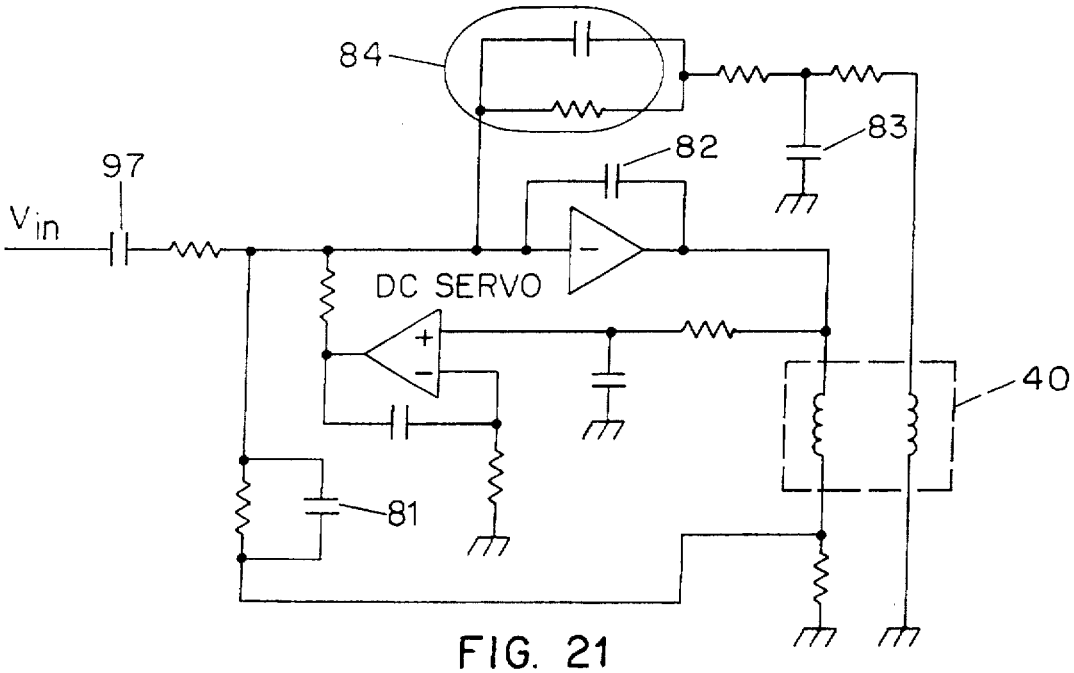
FIG. 21

SPEAKER AND AMPLIFIER SYSTEM

BACKGROUND

Recent decades have seen numerous developments in high-fidelity sound reproduction. Electronic and mechanical components made available to amplifier manufacturers have permitted the design of amplifiers that have better linearity and frequency response and lower distortion. Such amplifiers are smaller in size, less fragile, and less expensive. The audio sources (e.g. multiplexed stereo FM, digital compact disk, and compact cassette tape) are greatly improved over those previously available, and are dropping in cost. The electrical signals provided to the terminals of the speakers of a stereo sound system are, in present-day times and at modest cost, of a quality and fidelity that would have been unavailable to the consumer of two decades ago, except at prohibitive cost.

Those skilled in the art will appreciate, however, that one aspect of a high-fidelity sound system has remained stubbornly resistant to these improvements, namely the technology whereby the electrical energy of a sound system is converted to accoustic (airborne) energy: the speakers.

FIG. 1 shows the impedance of a electromagnetic speaker driver. It consists of three components: $R_e$ is the voice coil dc resistance, $L_v$ is the voice coil inductance, and the parallel network of $L_m$, $C_m$ and $R_m$ is the motor impedance. The inclusion of $L_m$, $C_m$ and $R_m$ is a result of the energy conversion process between electric energy and mechanical energy in the electromagnetic speaker driver. To be more specific, the mass of the diaphragm causes $C_m$ to appear in the driver's impedance, the friction for $R_m$, and the compliance of the diaphragm assembly for $L_m$. There are known formulae to relate the values of $C_m$, $R_m$ and $L_m$ to the mechanical parameters of the driver. If one puts a driver in a box, the measured impedance changes. There will be a network, which is related to the mechanical parameters of the box, appeared in parallel with the motor impedance. FIG. 2 show the added networks for closed-enclosure and bass-reflexive types of boxes.

The analysis of the frequency response in these systems under a voltage-source input signal can be done as in FIG. 3. $Z_b$ is the added impedance component from the speaker box. In the bass frequency region, the importance of $L_v$ is very minor and hence omitted in FIG. 3. There is an equivalent mechanical system for the electrical system described in FIG. 3*b*. Alternatively, the analysis can be done on the mechanical system and result will be the same. Note that the dc resistance of the voice coil acts as part of the mechanical friction in the driver as seen from FIG. 3*b*.

In general, the bass response of a electromagnetic (boxed) speaker system (that is, the system including a electromagnetic driver (or drivers) and an enclosure in which the driver(s) resides) depends on the mechanical parameters of both the enclosure and the driver itself, as well as the voice coil dc resistance. Examples of the parameters for enclosure are the box volume and port resonance frequency (if the enclosure is ported or vented). Examples of the driver parameters are compliance, mass, and the friction of the diaphragm assembly. These parameters have to be carefully chosen so that the combined system provides good bass response. Very often the design procedure starts with some known parameters in the driver or the enclosure, then calculates the required values for the rest parameters. There are at least two implications here.

First, when one parameter (say enclosure volume) is altered during the design procedure, the drivers need to be redesigned so that they exhibit the new set of required parameters. Second, after one fixes some parameters and then calculates the required values for other parameters, these values may becomes unrealistic to implement mechanically, or the efficiency of the speaker system becomes unacceptable.

Several apparatus have been proposed to address the above-mentioned problem. The first type of apparatus uses a derived signal, which is related to the movement of the diaphragm in the driver, as feedback signal so that the velocity of the diaphragm will exhibit desired characteristics in the frequency domain. For instance, in a closed-enclosure system, the velocity of the diaphragm needs to be inversely proportional to frequency (in the piston frequency region) in order to provide truly flat frequency response. Such a requirement (for the diaphragm velocity) is independent of any mechanical parameters. Therefore, the frequency response of the speaker system does not depend on the mechanical parameters of the enclosure or the driver. The major disadvantage of this type of apparatus is that it is only feasible when the desired velocity is a simple function of the frequency. The closed-enclosure speaker system can be one example. On the other hand, to produce flat frequency response in a bass-reflexive speaker system, the velocity is a complex function of frequency and the mechanical parameters of the enclosure and the driver. This type of apparatus becomes impractical for a bass-reflexive system (or any other ported or vented box system).

The second type of apparatus, in which the output impedance is a combination of a negative resistance and a complex reactance, tries to change the "apparent" mechanical parameters such that they are different from the actual mechanical parameters. In essence, such apparatus provides a mechanism that "changes the mechanical parameters of the drivers electrically". The objective of the negative output resistance is to cancel the dc resistance in the voice coil so that the other part of the output impedance (the complex reactance) can interact directly with the motor impedance and its equivalent effects are the changes of mechanical parameters. One example of these type of apparatus that portrayed in U.S. Pat. No. 4,118,600. That approach can be applied to various type of speaker systems, ranging from closed-enclosure to bass-reflexive systems. However, a major problem with that approach is that the dc resistance in the voice coil is highly dependent on the temperature and hence the result of cancellation is not guaranteed in practice. For instance, copper, which is the most commonly used material for voice coils, has a temperature coefficient about 0.2%/°F. In the bass frequency region, the signals sustain longer than those in the other frequency region. Combined with the fact that the hearing threshold of human ears in bass frequency region is typically quite high, there will be a significantly higher amount of electric energy dissipated in the voice coils. The result is that the frequency response depends on the voice coil temperature, and hence is not stable. A major problem with the system proposed in this patent is the negative output resistance. As will discussed below, the system according to the invention avoids this problem.

An approach to the temperature-shift problem is suggested in U.S. Pat. No. 4,980,920. The patent suggests a temperature compensation circuit to address this problem, but the result is hardly satisfactory in practice as issues such as thermo-coupling between the voice coil and the temperature sensor, and the linearity of sensor outputs, challenge the long-term stability of such a system.

SUMMARY OF THE INVENTION

An improved sound reproduction system employs an amplifier system and a speaker. The speaker provides two feedback signals, one indicative of the current through the speaker voice coil and a second indicative of the velocity of the speaker diaphragm. The velocity signal is provided via the first feedback path to an input of the amplifier of the amplifier system. In one embodiment, the current signal is provided by the second feedback path through a bandpass filter to the amplifier input. The velocity measurement may be derived from a second voice coil coupled to the diaphragm, or may be derived from a piezoelectric sensor coupled thereto. The current signal may be derived from the voltage drop across a resistor placed in series with the speaker voice coil.

Preferably the bandpass filter characteristics (and optionally the velocity-derived first feedback characteristics) are optimized with respect to the electrical and mechanical characteristics of the speaker and its enclosure. This matching may be accomplished by means of fixed components in an amplifier system that is dedicated for use with a particular speaker and enclosure. Optimally, however, the matching is accomplished so that the amplifier system is usable with any of a number of speaker/enclosure arrangements. A circuit card is provided with the speaker system, and electrical components in the circuit card are selected in relation to the electrical and mechanical characteristics of the speaker system. The circuit card is plugged into a connector at the amplifier system, and in this way the feedback coupling is optimized for the particular speaker system associated with that circuit card.

Stated differently, the objective of the present invention is to provide a driving apparatus for a speaker system so that the apparent mechanical parameters of the driver are different from the actual parameters without putting a negative resistance in the output impedance of the apparatus, in order to achieve excellent and stable bass frequency response. This objective is achieved using a combination of current sensing and motional signal feedback. That is, the signals correspondent to the current flow through the voice coil of the driver and movement of the diaphragm are put in the closed loop of the driving apparatus so that the equivalent effect of the arrangement is the change in the apparent mechanical parameters of the driver.

DESCRIPTION OF THE FIGURES

The invention will be described with respect to a drawing, of which:

FIG. 17*a* shows the high-pass filter of FIG. 16*b;*

FIG. 17*b* shows the high-pass filter of FIG. 17*a* after incorporating a DC feedback signal;

FIG. 17*c* shows the high-pass filter of FIG. 17*a* with a still different transfer function;

FIG. 18 shows the transfer function for the system of FIG. 11, in the special case in which $R_s$ is omitted;

FIG. 19*a* shows the low-pass filter of FIG. 16*b;*

FIG. 19*b* shows the low-pass filter of FIG. 19*a* with a different transfer function;

FIG. 19*c* shows the low-pass filter of FIG. 19*a* employing a shallower slope of filter;

FIG. 21 shows in schematic form a prototype embodiment of the invention.

DETAILED DESCRIPTION

Figure 1:
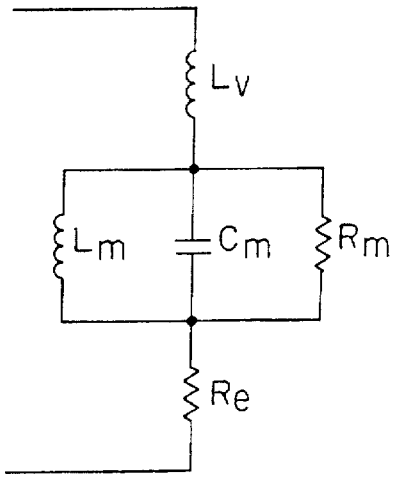
FIG. 1 shows in schematic form an impedence model for a generalized audio speaker.
Figure 2:
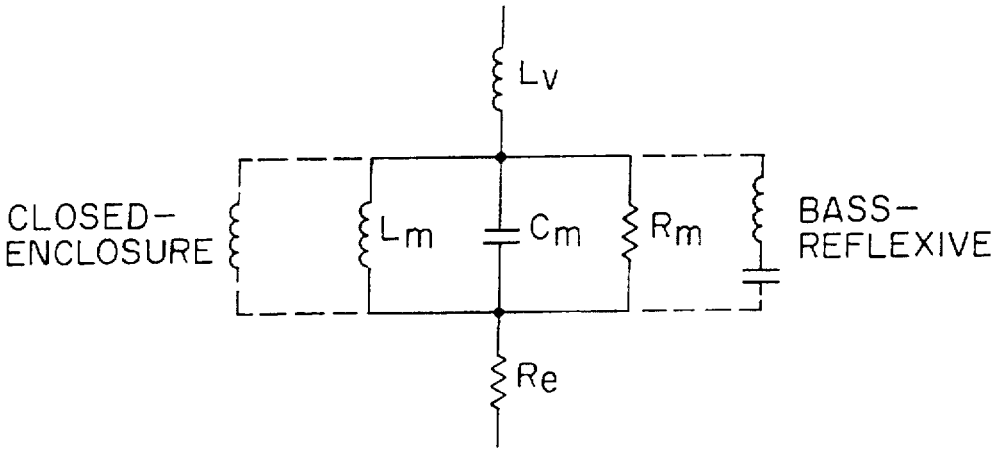
FIG. 2 shows the model of FIG. 1 with additional components modeling a speaker in an enclosure.
Figure 3A:
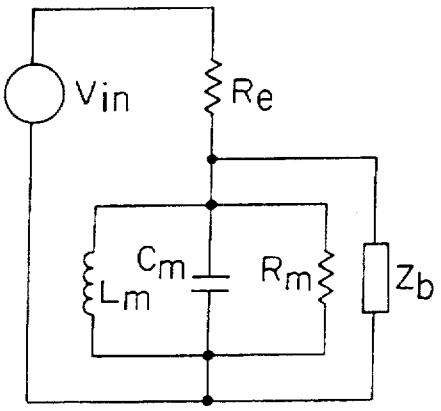
FIGS. 3*a* and 3*b* show equivalent circuits resulting from analysis of the frequency response of the system of FIGS. 1 or 2.
Figure 3B:
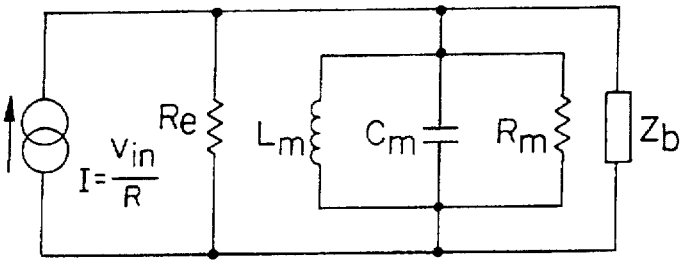
Figure 4:
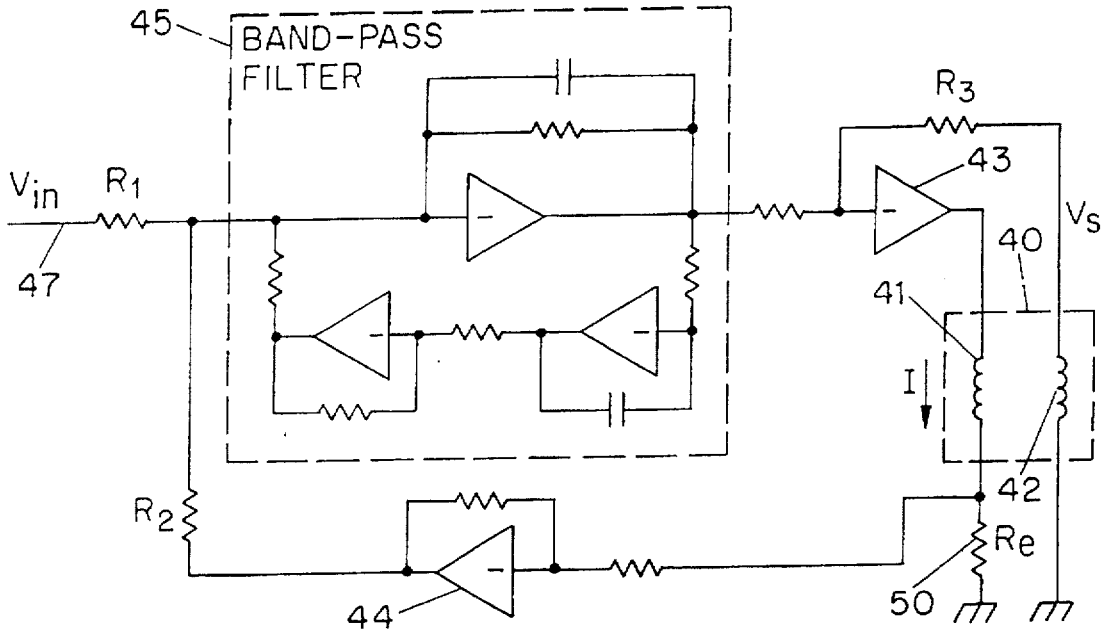
FIG. 4 shows in functional block diagram form an embodiment of the invention.

FIG. 4 shows one embodiment of the present invention. The speaker driver 40 has two voice coils 41, 42. Coil 41 is used as the load for the amp 43 to convert electrical energy to mechanical energy. The second voice coil 42 is for deriving the motional (velocity) feedback signal. The voltage applied to the driving voice coil 41 has two components: one is the drop across the dc resistance of the voice coil 41 and the other is the induced voltage caused by the movement of voice coil in the static magnetic field of the speaker. The latter is exactly the voltage drop across the motor impedance in FIG. 1. (This is statement is, of course, an approximation as the inductance of the voice coil 41 also contributes part of the induced voltage. However, let us now assume $L_v$ is very small and can be ignored.) Assume that these two voice coils 41, 42 are closely coupled (for instance, wound on the same former or coilform) so that the induced voltage at the sensing voice coil 42 $V_s$ is a constant factor $K_s$ of the induced voltage of the driving voice coil 41 $V_d$. That is, $$V_s = K_s \cdot V_d$$

Moreover, if $R_3$ is very high so that very little current is drawn from the sensing voice coil 42, then the voltage drop due to the dc resistance of the sensing voice coil 42 can be ignored. Therefore the voltage drop between the two terminals of sensing voice coil 42 is exactly $V_s$.

Figure 5:
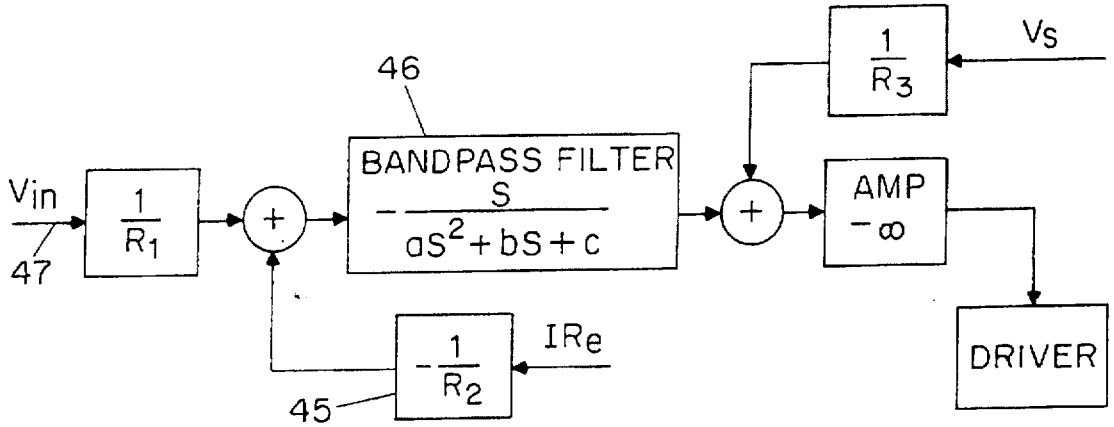
FIG. 5 shows an equivalent transfer function diagram for FIG. 4.

FIG. 5 shows the block diagram of FIG. 4. Let us assume the gain of the bottom inverter 44 in FIG. 4 is −1, therefore the sign of $1/R_2$ 45 in FIG. 5 is negative. Furthermore, the transfer function 46 of the basspass filter 45 is assumed as shown in FIG. 5. If the amp 43 has infinite gain, then the input to the amp 43 should be zero, that is, $$\left(-V_{in}\cdot\frac{1}{R_1}+\frac{R_e}{R_2}I\right)\left(\frac{S}{aS^2+bS+c}\right)+\frac{V_s}{R_3}=0 \quad (4)$$

$$\left(-V_{in}\cdot\frac{1}{R_1}+\frac{R_e}{R_2}I\right)\left(\frac{S}{aS^2+bS+c}\right)+\frac{K_s\cdot V_d}{R_3}=0$$

$$-\frac{R_3}{R_1K_s}\left(\frac{S}{aS^2+bS+c}\right)V_{in}+\frac{R_eR_3}{R_2K_s}\left(\frac{S}{aS^2+bS+c}\right)I+V_d=0$$

$$\text{or}\ \frac{R_3}{R_1K_s}\left(\frac{S}{aS^2+bS+c}\right)V_{in}=\frac{R_eR_3}{R_2K_s}\left(\frac{S}{aS^2+bS+c}\right)I+V_d$$

where I is the current flow through the driving voice coil 41.

Figure 6A:
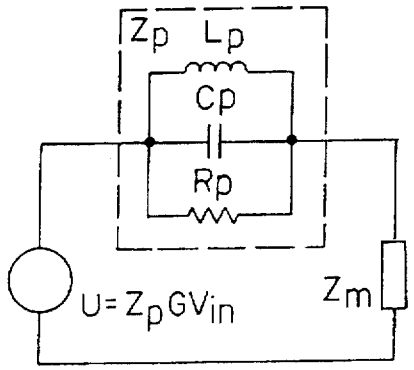
FIGS. 6*a*, 6*b* and 7 show equivalent circuits to FIG. 5.

Equation (4) shows that the system amplifies the input signal 47 with a magnitude of basspass characteristics, drives the motor impedance $Z_m$ of the driving voice coil 41 and has an output impedance equivalent to a parallel network consisting of R, L and C components as shown in FIG. 6. Note that $V_d=Z_mI$. The values of the components in FIG. 6 are as follows:

$$G=\frac{R_2}{R_1R_e}$$

$$C_p=\frac{R_2K_sa}{R_eR_3}$$

$$R_p=\frac{R_eR_3}{R_2K_sb}$$

$$L_p=\frac{R_eR_3}{R_2K_sc}$$

Figure 6B:
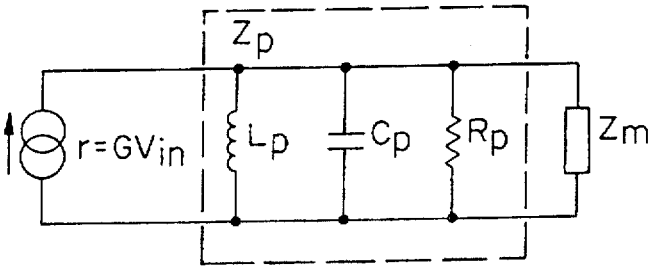
Figure 7:
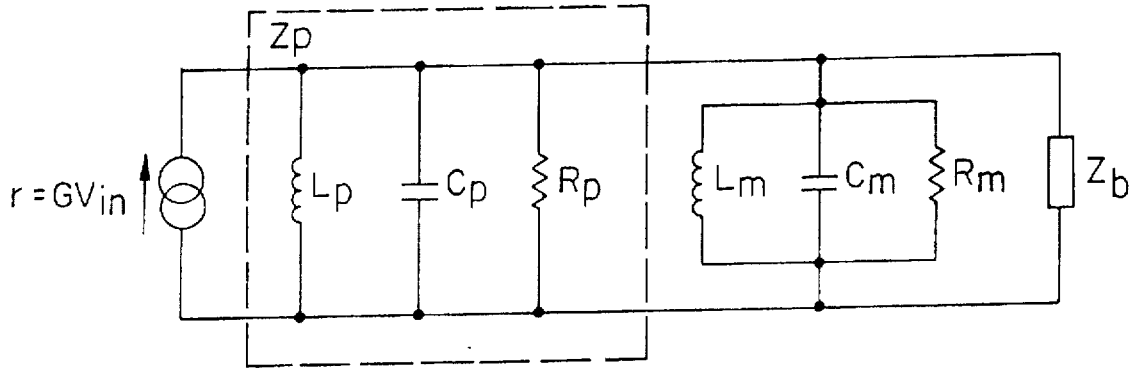

If we expand $Z_m$ in FIG. 6*b*, we get FIG. 7.

As implied in FIG. 7, $Z_p$ can be combined with $Z_m$ so that the system acts as if the driver has a different set of parameters. More importantly, this is done without using a negative resistance in the output impedance.

The circuit in FIG. 4 can be made much simpler as will now be described.

In general the required value $R_p$ in $Z_p$ (FIG. 7) is very small so that the transfer function of the bandpass filter has real-value poles, that is $$\frac{S}{aS^2+bS+c}=\frac{S}{(dS+e)(fS+g)} \quad (9)$$

Figure 8A:
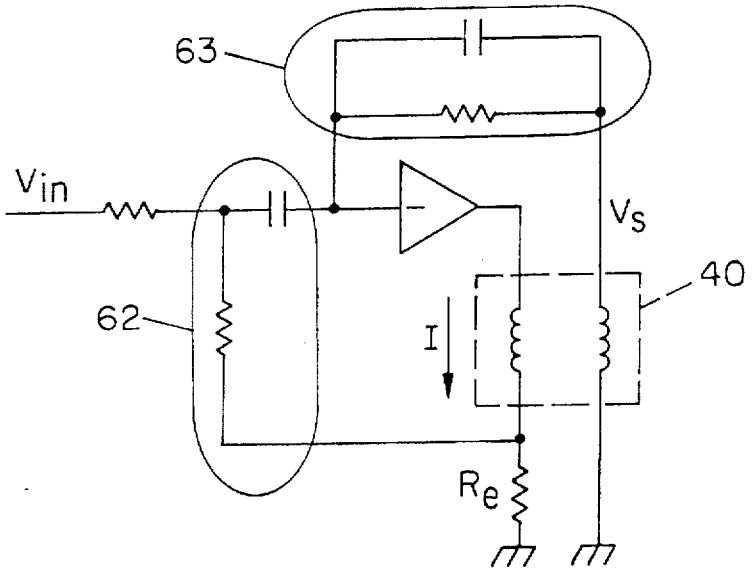
FIGS. 8*a* and 8*b* show simplified embodiments of the system of FIG. 4.

This reduces the circuit of FIG. 4 to the one of FIG. 8*a*. If only $_{Cm}$ and $R_m$ need to be modified (that is, only $C_p$ and $R_p$ need to be in $Z_p$ of FIG. 7), then the circuit can be simplified to that of FIG. 8*b*. It will be appreciated, however, that these are very ideal cases. When one apply the techniques described here to real-world speaker drivers, at least two issues need to be considered: (1) dc offset voltage of the amp 43, and (2) the impact of $L_v$ on the frequency response.

Figure 8B:
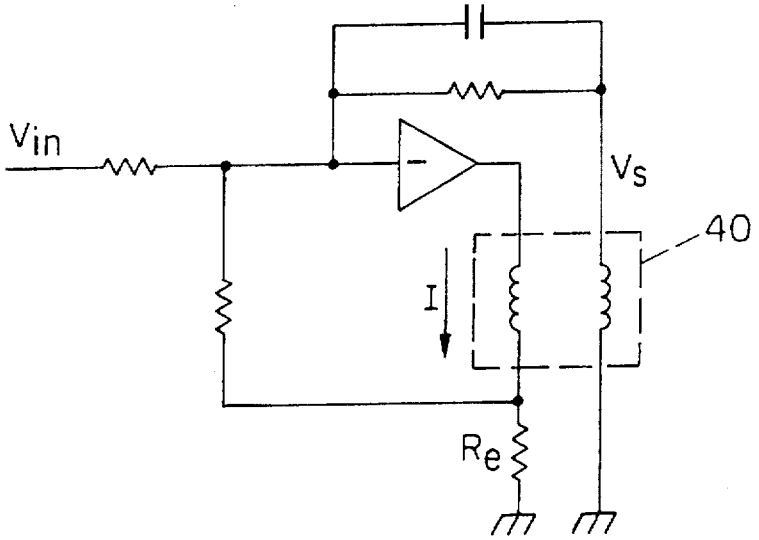
Figure 9A:
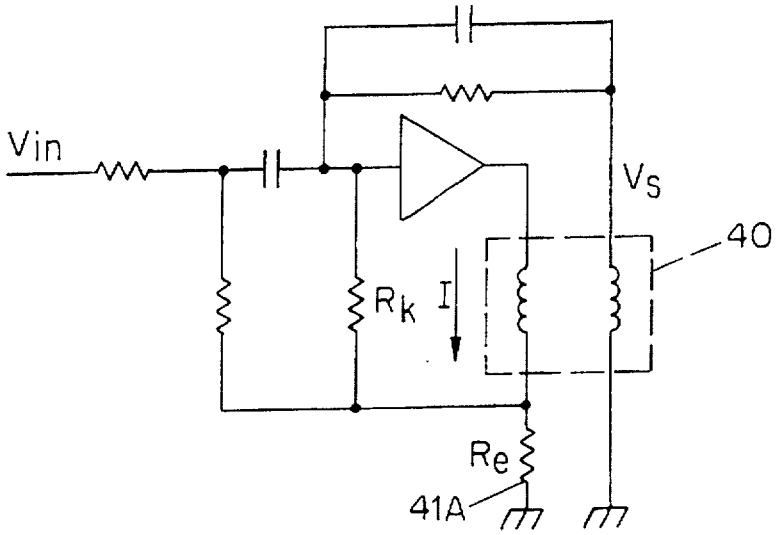
FIGS. 9*a* and 9*b* shows embodiments of the invention employing DC feedback.
Figure 9B:
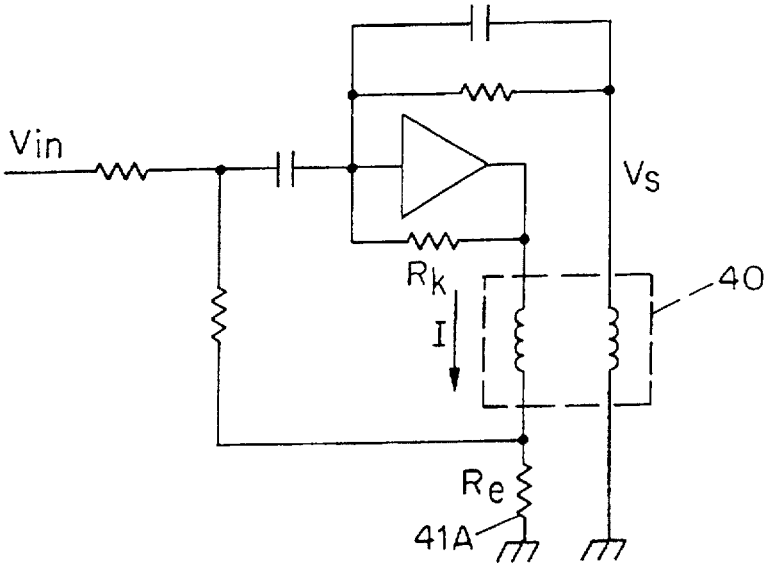
Figure 10:
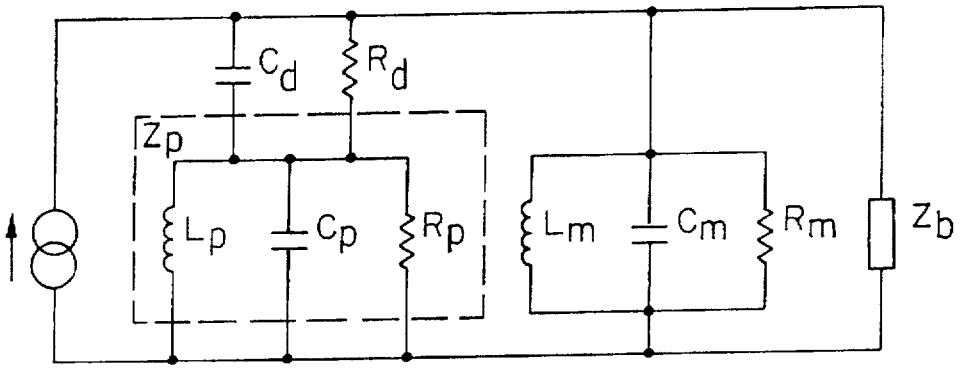
FIG. 10 shows an equivalent circuit for FIGS. 9*a* and 9*b;*

As may be appreciated from FIG. 8*a*, there is no DC feedback, as a result of which the system is not stable at DC. FIG. 8*b* does have DC feedback, so does not present this problem. There are at least two solutions here. First, one may add a DC feedback loop either from the current sensing resistor (FIG. 9*a*) or from the amp's output (FIG. 9*b*). Either way $Z_p$ is no longer a network of three components as modeled in FIG. 7. FIG. 10 shows the new $Z_p$, which may be compared with that of FIG. 7.

The impact of $C_d$ and $R_d$ on frequency response can be minimized by using higher value of $R_k$ in FIG. 9.

Figure 11:
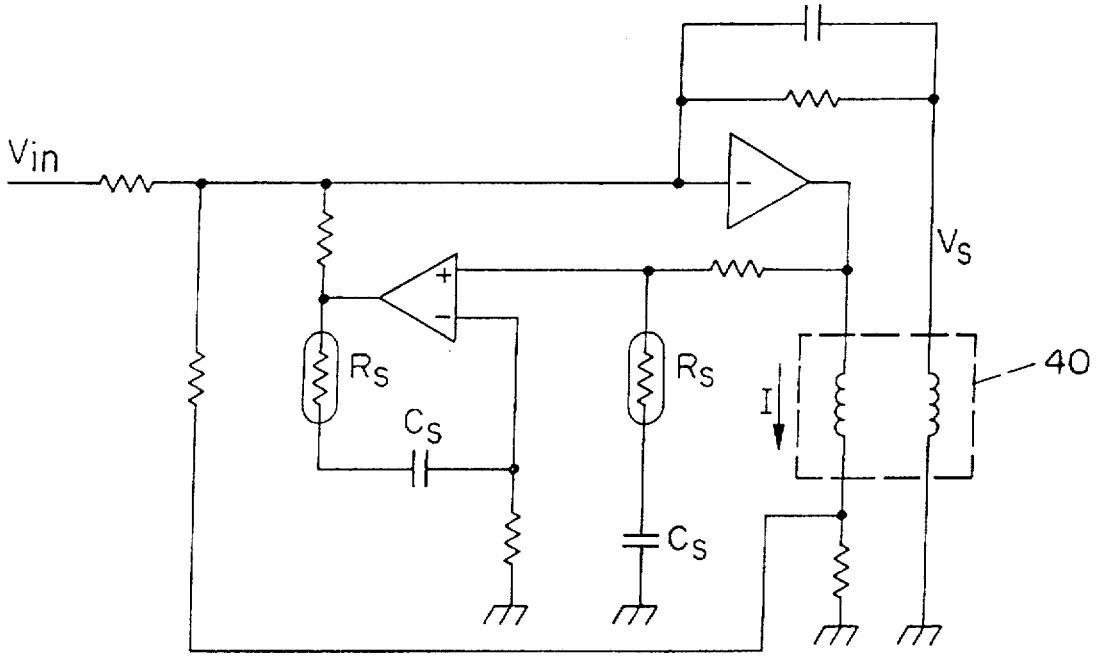
FIG. 11 shows an embodiment of the invention employing a DC servo loop.
Figure 12A:
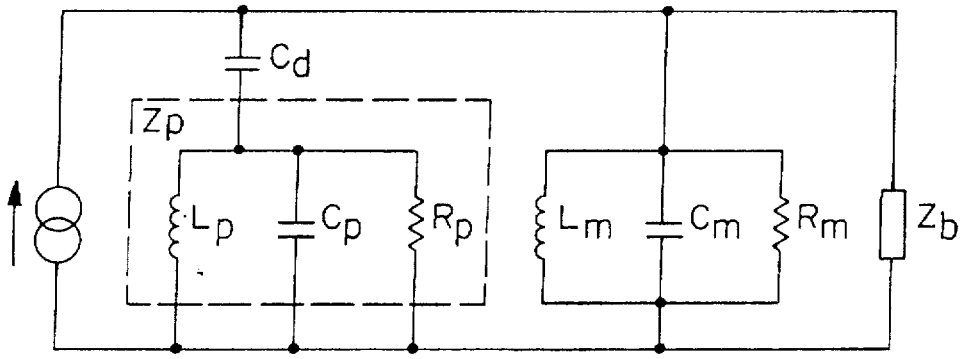
FIGS. 12*a* and 12*b* show equivalent circuits for the system of FIG. 11.

Another solution to the DC stability issue is to add a DC servo loop in the system. One possible configuration is shown in FIG. 11. The equivalent circuit of FIG. 11 is shown in FIG. 12*a*.

Figure 12B:
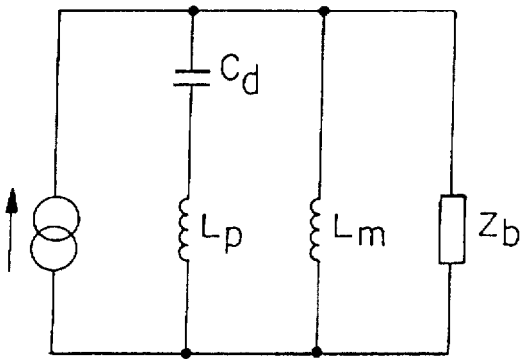

A potential problem with DC servo loops is the possibility of low-frequency oscillation. The equivalent circuit at very low frequency is shown in FIG. 12*b*, which is an LC network with no damping resistor. The remedy is to add a serial resistor to $C_s$ in FIG. 11 so that the equivalent circuit becomes similar to FIG. 10.

Figure 13A:
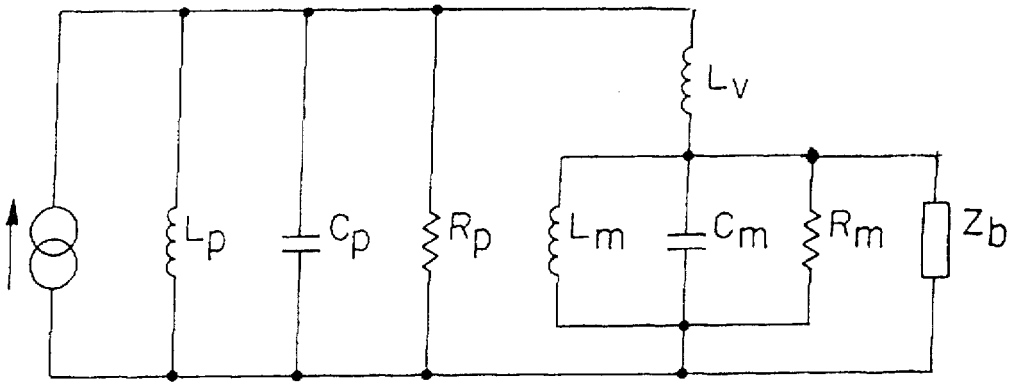
FIGS. 13*a* and 13*b* show counterparts to FIGS. 12*a* and 12*b* taking $L_v$ into account.
Figure 13B:
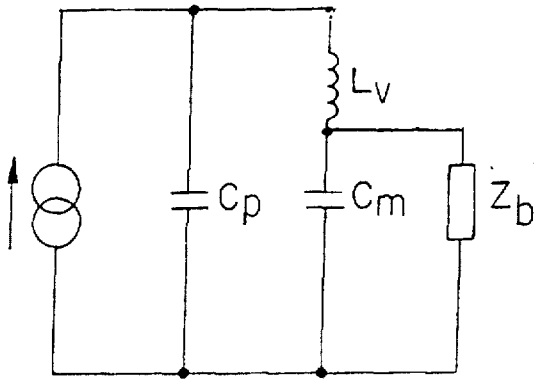

Another potential problem (from $L_v$) also is addressed. The voltage drop across $L_v$ is supposed to be part to the induced voltages $V_d$ and $V_s$. Previous analysis ignores it because we assume its effect is very small. If the analysis is to be more general, however, it is necessary to consider the case in which its effect is not small. (Experience shows that it is not easy, nor cheap, reduce the value of $L_v$.) The impact of $L_v$ to frequency response is restricted to high frequency. FIG. 13*a* and 13*b* shows the equivalent circuit with $L_v$ considered.

Figure 14:
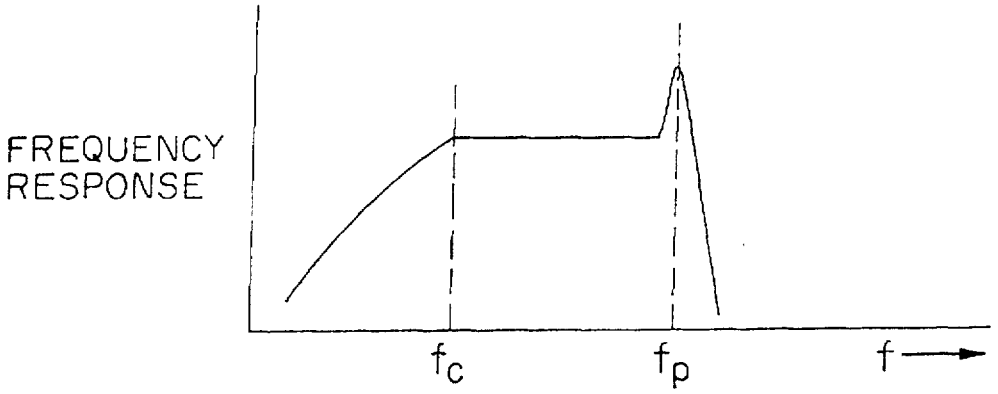
FIG. 14 shows the response of a system according to the present invention.

FIG. 14 shows the actual response of a system employing the present invention. The $f_c$ in FIG. 14 is the cut-off frequency of the speaker system. The peak at $f_p$ is caused by $L_v$, $_{Cm}$ and $C_p$. Another impact of $L_v$ is the increased distortion at frequencies nearby to $f_p$. This is because $L_v$ is not a constant value. As a matter of fact, it is the major source of distortion at high frequency.

One investigator has addressed this problem by a particular current-drive technology. As $L_v$ changes, $f_p$ also changes. Translating it to time domain, it means that the distortion is significantly increased around $f_p$ and above.

Figure 15A:
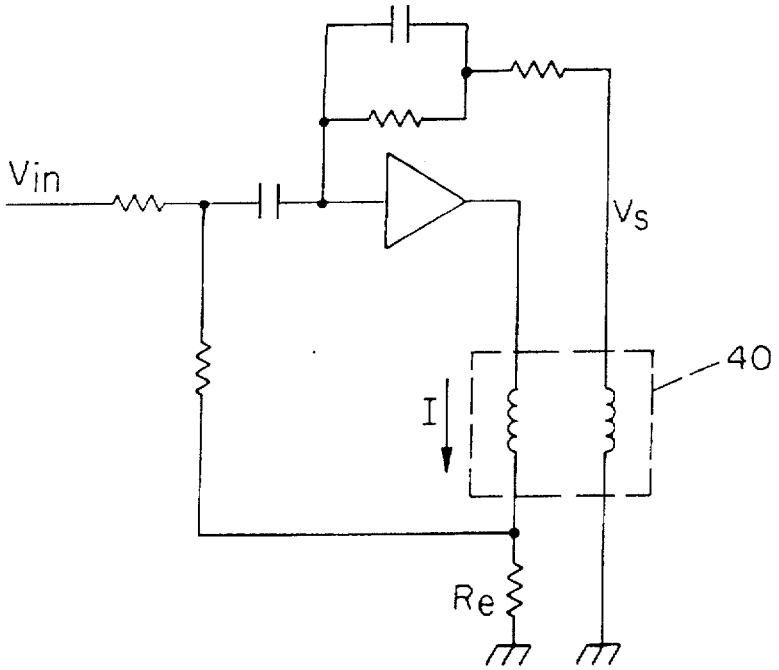
FIG. 15*a* shows an embodiment of the invention in which a resistor is included in the velocity feedback path.
Figure 15B:
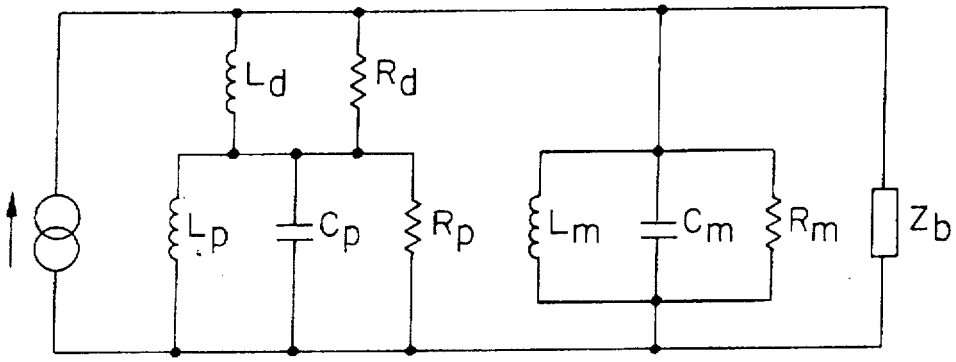
FIG. 15*b* shows an equivalent circuit for FIG. 15*a;*

One solution to this problem is using two drivers in one box: one facing inward and one facing outward. This arrangement can cancel the odd-order harmonic distortion. For the even-order harmonic distortion, there is little one can do without radical change in the driver mechanical structures. Another possibility to reduce the impact is putting a resistor in series with the $Z_p$ in FIG. 7 so that the peak at $f_p$ is reduced. The problem is that, in the circuit of FIG. 8, it is very difficult to include exactly one resistor. One approach is that of FIG. 15*a*. FIG. 15*b* shows the equivalent circuit.

As will be appreciated by those skilled in the art, there are engineering trade-offs. Of course those skilled in the art can devise obvious variants of the embodiments shown here, all of which are intended to be encompassed by the invention as defined by the claims that follow.

The concept of impedance loading, as I have demonstrated here, can be extended. Let us define the loading in FIG. 7 as simple impedance loading, and the loading in the other figures as complex impedance loading. The impact of the complex impedance loading is that the frequency response could deviate from the ideal cases (simple impedance loading). This characteristic is very helpful as one can implement (part of) the filtering function required to crossover to high frequency speaker driver using complex impedance loading. A computer program can be very helpful in tabulating all possible combinations of values for each commonly used alignment.

The derivation of the motional feedback signals will now be described. Many mechanisms have been proposed for derivation of the motional feedback signals. In the preferred embodiment, the driving and sensing voice coils are wound on the same former and closely placed. It is the cheapest way to do it and is commercially available. In these cases, the velocity signal is derived. Alternatively, one can use piezoelectric accelerometers, in which case the derived signals are the acceleration of the diaphragm, rather than the velocity, in which case the system of the present invention must be modified accordingly. In FIG. 4, for example, either the bandpass filter is changed to a high-pass filter, or the feedback resistance is replaced by an inductance. Either way, the network can still be decomposed, and what changes is the precise nature of the piezo feedback loop. Yet another approach is simply to take the piezo output and convert it to a velocity signal, for example through integration.

As will be appreciated, what is provided is a system offering compact-sized bass reproduction speakers, in which the required mechanical parameters are difficult to implement mechanically. Improved bass response is provided. Such a system offers its benefits especially with car (automotive) stereo systems and home theater systems. One advantage is the simplicity of the apparatus compared with other prior art approaches.

Returning to equation 9 we have:

$$\frac{S}{aS^2+bS+c}=\frac{S}{(dS+e)(fS+g)}=\frac{\left(\frac{1}{fS+g}\right)}{\left(\frac{dS+e}{S}\right)}$$

Figure 16A:
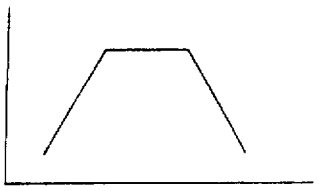
FIG. 16*a* shows a generalized bandpass filter.
Figure 16B:
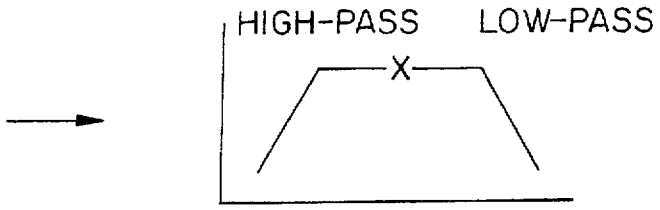
FIG. 16*b* shows the decomposition of such a filter into distinct high-pass and low-pass filters.

The denominator is the impedance of the feedback network for the current signal and the system input signal (for example the circuitry 62 in FIG. 8*a*); the numerator is the impedance of the feedback network for the velocity signal (for example circuitry 63 in FIG. 8*a*). In FIG. 16, the high-pass filtered is assigned to the current feedback signal and low pass is assigned to the velocity feedback signal. Alternatively, one can assign the low pass filter to current feedback signal and high-pass filter to motional feedback signal. In the following, we limit our discussion to the filter assignment described in FIG. 16 as the other case is similar. In other words, the bandpass filter (for example filter 45 in FIG. 4) is decomposed into distinct filters.

In one variant, if a=0 in the bandpass filter, the velocity feedback network can be replaced by a signal resistor.

In another variant, if c=0 in the bandpass filter, the current feedback network can be replaced by a single resistor.

In practice, high-pass and low-pass filters can be slightly modified to resolve some real-world problems. For instance, as mentioned previously, in order to ensure DC stability, we need to add DC feedback signal from the current signal (or the amp output). FIGS. 17*a*, 17*b*, and 17*c* show the possible new transfer function of the high-pass filter after incorporating the DC feedback signal. In FIG. 17*b* (for the circuits in FIG. 9*a* and 9*b*), the new transfer function is:

$$\frac{1}{R}+\frac{S}{dS+e}$$

In FIG. 17*c* (refer to FIG. 11), the new transfer function is $$R+CS+\frac{S}{dS+e}$$

In FIG. 11, the DC servo loop is different from the commonly seen ones (which has $C_s$ only, no $R_s$) Adding $R_s$ is to prevent a possible oscillation. FIG. 18 shows the transfer function if $R_s$ is not included.

What is shown in FIGS. 17*b* and 17*c* is the filter only for the current feedback signal. The network connecting the system input and the amp still has the original high-pass characteristics.

The low-pass filter can also be varied. FIG. 19 shows two possible variations of the low-pass section. The main purpose for these variations is to reduce the resonance peak at $f_p$ in FIG. 14. In FIG. 19*b*, a zero is added to the network. The new transfer function becomes (refer to FIG. 9*a* and 9*b*):

$$\frac{1}{r}+\frac{1}{fs+g}$$

Alternatively, although this is thought to be less workable, it might be proposed to reduce the declining slope to smaller than 6 db/octave using a multi-pole and multi-zero network.

It should be appreciated that in the system according to the invention, the positional or motional feedback is a negative feedback, and that the current feedback is also a negative feedback.

Figure 20A:
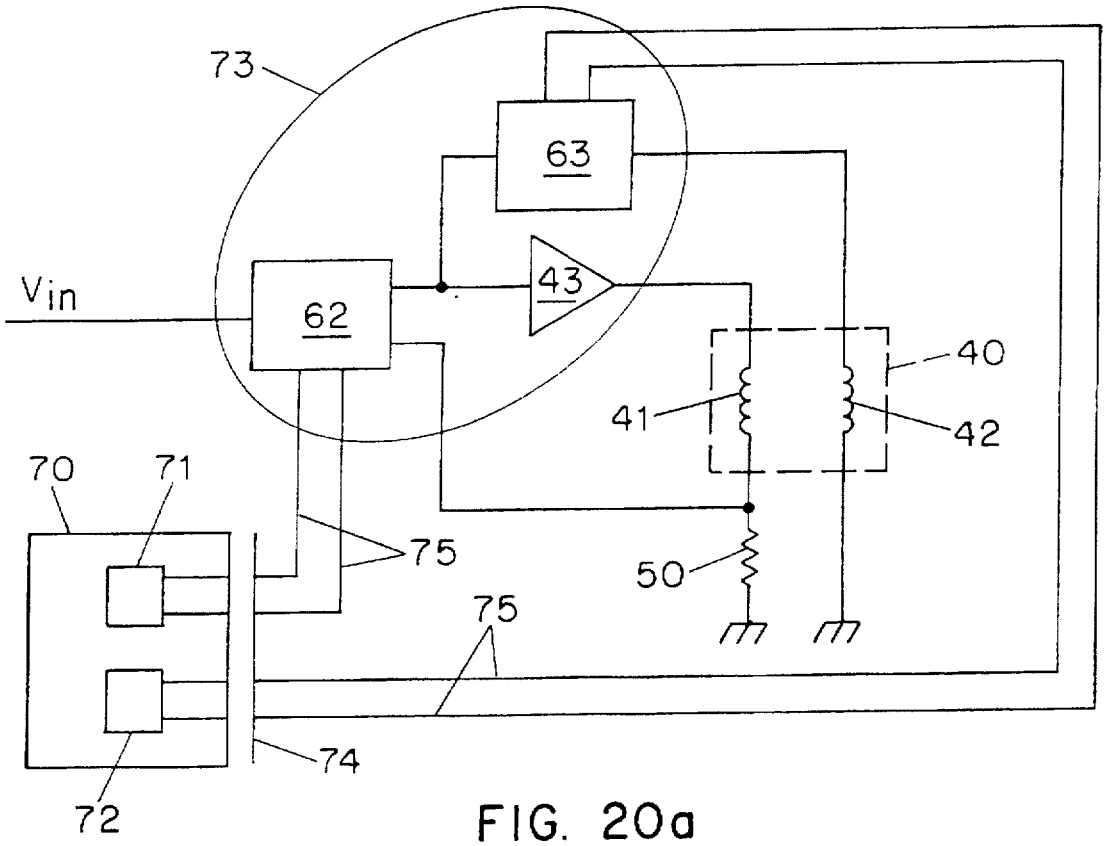
FIGS. 20*a* and 20*b* show in functional block diagram form embodiments of the invention employing a plug-in card.

FIG. 20*a* shows an embodiment of the invention in which the speaker is distributed with a matched circuit card 70. Circuit card 70 has components 71, 72 associated with electrical/physical properties of the speaker. (In simpler embodiments the circuit card 70 has only one of components 71, 72.) The amplifier system (roughly, region 73 in FIG. 20) is generalized to work with a variety of different speakers. When a particular speaker is installed to the system, the plug-in card 72 is plugged in to connector 74. This permits component(s) 71 to be connected with circuitry 62, and permits component(s) 72 to be connected with circuitry 63. In this way the speaker and amplifier offer the benefits of the invention. In FIG. 20 the components 71, 72 are portrayed as resistors, but it should be understood that any of a number of different components, such as capacitors, inductors, or combinations of these, may be provided (in connection with appropriately arranged filters 62, 63) to customize the amplifier appropriately for the particular speaker being installed. It will also be appreciated that the wires 75 are depicted as four wires, but that some other number of wires would suffice depending on the particular circuitry 62, 63.

Figure 20B:
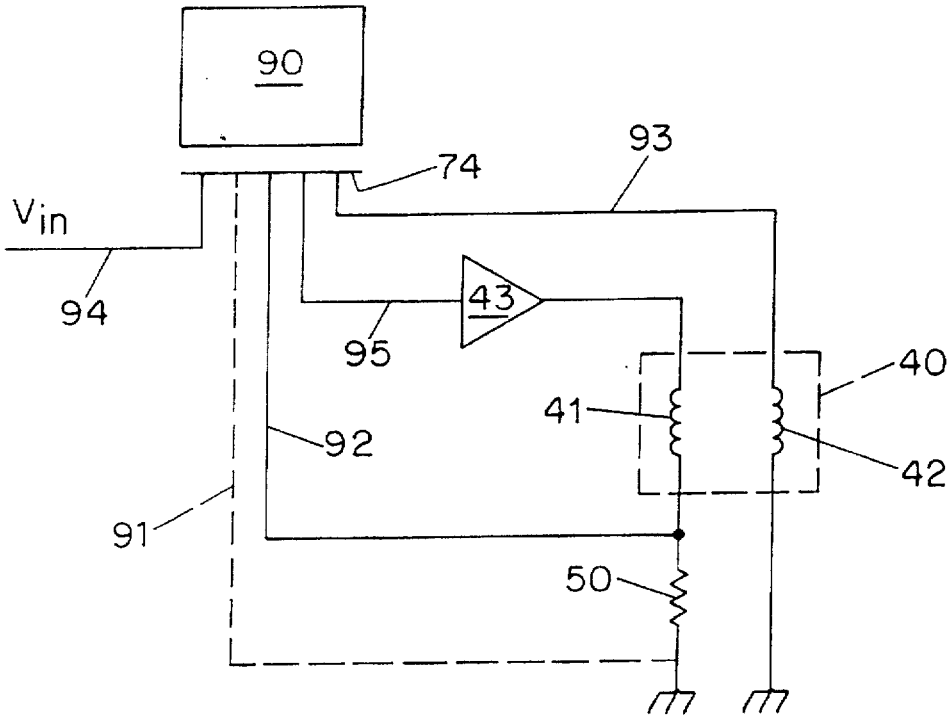

FIG. 20*b* shows yet another embodiment for use in a system according to the invention. In this embodiment a connector has a plurality of electrical contacts, said contacts including a first contact connected with the amplifier input via line 95, a second contact connected with the first voice coil's current sensing means via line 92, a third contact connected with the system signal input via line 94, and a fourth contact connected with the motional feedback sensor, in this figure a second voice coil, via line 93. Optionally a fifth contact is connected with the second end of the resistor 50 via line 91. In this way, a filter 90 may be connected with the connector. Its coupling of the second voice coil with the amplifier input defines a first feedback, its coupling of the resistor with the amplifier input defines a second feedback. It also couples the system signal input with the amplifier input, as a result of which an audio signal on the audio signal input is reproduced in the speaker. The filter 90 is matched to the physical and accoustical qualities of the speaker.

FIG. 21 is the schematic of a prototype that has been built. In this configuration only the mechanical mass and friction have to be modified. Additional components, namely capacitors 81, 82, and 83 are not required for the invention but provide better stability at high frequency. In this embodiment, the positional feedback is by means of a filter 84 which might best be characterized as a modified low-pass filter. A coupling capacitor 97 couples the input audio signal with the amplifier.

Those skilled in the art will appreciate that stated in its most general terms, the invention presents a way of providing improved bass response. To accomplish this end, first and second negative feedback paths are provided. The first negative feedback means couples the motional measurement means output with the amplifier input; and the second negative feedback means couples a current measurement means electrically coupled with the voice coil driven by the amplifier with the amplifier input. In the simplest possible embodiments, one or the other of the two negative feedback means includes a frequency characteristic correcting circuit which is set to have variable gain dependent on the frequency of the input signal.

I claim:

1. A sound reproduction system comprising an amplifier system, a speaker, and first and second negative feedback means;

the speaker having a diaphragm, a first voice coil mechanically coupled with the diaphragm, and motional measurement means having an output;

the amplifier system comprising an amplifier with an input and an output, the amplifier output electrically coupled to the first voice coil;

the first feedback means comprising first circuitry coupling the motional measurement means output with the amplifier input; and the second feedback means comprising a current measurement means electrically coupled with the first voice coil and having an output, and a bandpass filter coupling the current measurement means output with the amplifier input.

2. The system of claim 1 wherein the bandpass filter additionally couples a system input signal with the amplifier input.

3. The system of claim 1 wherein the speaker further comprises a coil former upon which the first voice coil is wound, and further comprises a second voice coil wound on the coil former, and wherein the first and second voice coils are disposed within a permanent magnetic field, the second voice coil comprising the motional measurement means.

4. The system of claim 1 wherein the speaker further comprises a piezoelectric sensor mechanically coupled with the diaphragm, the piezoelectric sensor having an electrical output indicative of deflection thereof, the piezoelectric sensor comprising the motional measurement means and the output of the piezoelectric sensor comprising the motional measurement means output.

5. The system of claim 1 wherein the current measurement means comprises a resistor disposed electrically in series with the first voice coil, the voltage drop across the resistor comprising the output of the current measurement means.

6. The system of claim 1 wherein the amplifier system further comprises a connector electrically coupled with the bandpass filter and with the first circuitry, and a board removably connectable with the connector, said board comprising at least a first electrical component electrically coupled with the bandpass filter and at least a second electrical component electrically coupled with the first circuitry.

7. An amplifier system comprising a amplifier and first and second negative feedback means;

the amplifier having an input and an output, the amplifier output adapted for electrical coupling with a speaker voice coil;

the first feedback means comprising first circuitry adapted for electrical coupling with a speaker diaphragm motional measurement means; and the second feedback means comprising a current measurement means adapted for electrical coupling with the speaker voice coil and having an output, and a bandpass filter coupling the current measurement means output and a system input signal with the amplifier input.

8. The system of claim 7 wherein the bandpass filter additionally couples a system input signal with the amplifier input.

9. The system of claim 7 wherein the current measurement means comprises a resistor disposed electrically in series with the first voice coil, the voltage drop across the resistor comprising the output of the current measurement means.

10. The system of claim 7 wherein the amplifier system further comprises a connector electrically coupled with the bandpass filter and with the first circuitry, and a board removably connectable with the connector, said board comprising at least a first electrical component electrically coupled with the bandpass filter and at least a second electrical component electrically coupled with the first circuitry.

11. A method of sound reproduction comprising: electrically coupling an an amplifier system with a speaker, whereby the amplifier drives the speaker, the speaker having a diaphragm and a first voice coil mechanically coupled thereto;

providing a first negative feedback to the amplifier indicative of changes in the position of the diaphragm; and providing a second negative feedback to the amplifier indicative of the current through the first voice coil, said second feedback further characterized as a bandpassed function of the current.

12. The method of claim 11 wherein the step of providing the first feedback further comprises providing a second voice coil mechanically coupled to the diaphragm, voltage induced in the second voice coil being indicative of changes in the position of the diaphragm.

13. The method of claim 11 wherein the step of providing the first feedback further comprises providing a piezoelectric sensor mechanically coupled with the diaphragm, the piezoelectric sensor having an electrical output indicative of deflection thereof, voltage induced in the piezoelectric sensor being indicative of changes in the position of the diaphragm.

14. A speaker system comprising a speaker and a board;

the speaker having a diaphragm, a first voice coil mechanically coupled with the diaphragm, and positional measurement means coupled with the diaphragm, the positional measurement means having an output;

the board comprising at least a first electrical component and at least a second electrical component, the first and second electrical component indicative of electrical or mechanical characteristics of the speaker, wherein the speaker further comprises a piezoelectric sensor mechanically coupled with the diaphragm, the piezoelectric sensor having an electrical output indicative of deflection thereof, the piezoelectric sensor comprising the positional measurement means and the output of the piezoelectric sensor comprising the positional measurement means output.

15. A sound reproduction system comprising an amplifier system, a speaker, and first and second negative feedback means; the speaker having a diaphragm, a first voice coil mechanically coupled with the diaphragm, and motional measurement means having an output;

the amplifier system comprising an amplifier with an input and an output, the amplifier output electrically coupled to the first voice coil;

the first feedback means comprising first circuitry coupling the motional measurement means output with the amplifier input via a low-pass filter; and the second feedback means comprising a current measurement means electrically coupled with the first voice coil and having an output, and a high-pass filter coupling the current measurement means output with the amplifier input.

16. The system of claim 15 wherein the high-pass filter additionally couples a system input signal with the amplifier input.

17. The system of claim 15 wherein the speaker further comprises a coil former upon which the first voice coil is wound, and further comprises a second voice coil wound on the coil former, and wherein the first and second voice coils are disposed within a permanent magnetic field, the second voice coil comprising the motional measurement means.

18. The system of claim 15 wherein the speaker further comprises a piezoelectric sensor mechanically coupled with the diaphragm, the piezoelectric sensor having an electrical output indicative of deflection thereof, the piezoelectric sensor comprising the motional measurement means and the output of the piezoelectric sensor comprising the motional measurement means output.

19. The system of claim 15 wherein the current measurement means comprises a resistor disposed electrically in series with the first voice coil, the voltage drop across the resistor comprising the output of the current measurement means.

20. The system of claim 15 wherein the amplifier system further comprises a connector electrically coupled with the high-pass and low-pass filters, and a board removably connectable with the connector, said board comprising at least a first electrical component electrically coupled with the high-pass filter and at least a second electrical component electrically coupled with the low-pass filter.

21. An amplifier system comprising an amplifier and first and second negative feedback means;

the amplifier having an input and an output, the amplifier output adapted for electrical coupling with a speaker voice coil;

the first feedback means comprising first circuitry including a low-pass filter adapted for electrical coupling with a speaker diaphragm motional measurement means; and the second feedback means comprising a current measurement means adapted for electrical coupling with the speaker voice coil and having an output, and a high-pass filter coupling the current measurement means output with the amplifier input.

22. The system of claim 21 wherein the high-pass filter additionally couples a system input signal with the amplifier input.

23. The system of claim 21 wherein the current measurement means comprises a resistor disposed electrically in series with the first voice coil, the voltage drop across the resistor comprising the output of the current measurement means.

24. The system of claim 21 wherein the amplifier system further comprises a connector electrically coupled with the high-pass filter and with the low-pass filter, and a board removably connectable with the connector, said board comprising at least a first electrical component electrically coupled with the high-pass filter and at least a second electrical component electrically coupled with the low-pass filter.

25. A method of sound reproduction comprising:

electrically coupling an an amplifier system with a speaker, whereby the amplifier drives the speaker, the speaker having a diaphragm and a first voice coil mechanically coupled thereto;

providing a first negative feedback to the amplifier indicative of changes in the position of the diaphragm, said first feedback further characterized as a low-passed function of the current; and providing a second negative feedback to the amplifier indicative of the current through the first voice coil, said second feedback further characterized as a high-passed function of the current.

26. The method of claim 25 wherein the step of providing the first feedback further comprises providing a second voice coil mechanically coupled to the diaphragm, voltage induced in the second voice coil being indicative of changes in the position of the diaphragm.

27. The method of claim 25 wherein the step of providing the first feedback further comprises providing a piezoelectric sensor mechanically coupled with the diaphragm, the piezoelectric sensor having an electrical output indicative of deflection thereof, voltage induced in the piezoelectric sensor being indicative of changes in the position of the diaphragm.

28. A sound reproduction system comprising an amplifier system, a speaker, and first and second negative feedback means:

the speaker having a diaphragm, a first voice coil mechanically coupled with the diaphragm, and positional measurement means coupled with the diaphragm, the positional measurement means having an output;

the amplifier system comprising an amplifier with an input and an output, the amplifier output electrically coupled to the first voice coil;

the first feedback means comprising first circuitry coupling the positional measurement means output with the amplifier input; and the second feedback means comprising a current measurement means electrically coupled with the first voice coil and having an output, and second circuitry coupling the current measurement means output with the amplifier input, wherein the speaker further comprises a coil former upon which the first voice coil is wound, and further comprises a second voice coil wound on the coil former, and wherein the first and second voice coils are disposed within a permanent magnetic field, the second voice coil comprising the positional measurement means.

29. A sound reproduction system comprising an amplifier system, a speaker, and first and second negative feedback means;

the speaker having a diaphragm, a first voice coil mechanically coupled with the diaphragm, and positional measurement means coupled with the diaphragm, the positional measurement means having an output;

the amplifier system comprising an amplifier with an input and an output, the amplifier output electrically coupled to the first voice coils;

the first feedback means comprising first circuitry coupling the positional measurement means output with the amplifier input; and the second feedback means comprising a current measurement means electrically coupled with the first voice coil and having an output, and second circuitry coupling the current measurement means output with the amplifier input, wherein the speaker further comprises a piezoelectric sensor mechanically coupled with the diaphragm, the piezoelectric sensor having an electrical output indicative of deflection thereof, the piezoelectric sensor comprising the positional measurement means and the output of the piezoelectric sensor comprising the positional measurement means output.

30. A method of sound reproduction comprising:

electrically coupling an an amplifier system with a speaker, whereby the amplifier drives the speaker, the speaker having a diaphragm and a first voice coil mechanically coupled thereto;

providing a first negative feedback to the amplifier indicative of changes in the position of the diaphragm; and providing a second negative feedback to the amplifier indicative of the current through the first voice coil, wherein the step of providing the first feedback further comprises providing a second voice coil mechanically coupled to the diaphragm, voltage induced in the second voice coil being indicative of changes in the position of the diaphragm.

31. A method of sound reproduction comprising:

electrically coupling an an amplifier system with a speaker, whereby the amplifier drives the speaker, the speaker having a diaphragm and a first voice coil mechanically coupled thereto;

providing a first negative feedback to the amplifier indicative of changes in the position of the diaphragm; and providing a second negative feedback to the amplifier indicative of the current through the first voice coil, wherein the step of providing the first feedback further comprises providing a piezoelectric sensor mechanically coupled with the diaphragm, the piezoelectric sensor having an electrical output indicative of deflection thereof, voltage induced in the piezoelectric sensor being indicative of changes in the position of the diaphragm.

32. A system for sound reproduction comprising an amplifier with an input and an output, a speaker with a first voice coil wound on a former and a second coil wound on the same former, a resistor having first and second ends, the first end of the resistor connected with a first end of the first voice coil, the first voice coil driven by the amplifier output, and a connector, the connector having a plurality of electrical contacts, said contacts comprising a first contact connected with the amplifier input, a second contact connected with said first end of the first voice coil, a third contact connected with a system signal input, and a fourth contact connected with the second voice coil, further comprising a filter connected with the connector, said filter coupling the second voice coil with the amplifier input thereby defining a first negative feedback, said filter coupling the resistor with the amplifier input thereby defining a second negative feedback, and said filter coupling the system signal input with the amplifier input, whereby an audio signal on the audio signal input is reproduced in the speaker.

33. A sound reproduction system comprising an amplifier system, a speaker, and first and second negative feedback means;

the speaker having a diaphragm, a first voice coil mechanically coupled with the diaphragm, and positional measurement means coupled with the diaphragm, the positional measurement means having an output;

the amplifier system comprising an amplifier with an input and an output, the amplifier output electrically coupled to the first voice coil;

the first feedback means comprising first circuitry coupling the positional measurement means output with the amplifier input; and the second feedback means comprising a current measurement means electrically coupled with the first voice coil and having an output, and a bandpass filter coupling the current measurement means output with the amplifier input, wherein the bandpass filter additionally couples a system input signal with the amplifier input.

34. A sound reproduction system comprising an amplifier system, a speaker, and first and second negative feedback means;

the speaker having a diaphragm, a first voice coil mechanically coupled with the diaphragm, and positional measurement means coupled with the diaphragm, the positional measurement means having an output;

the amplifier system comprising an amplifier with an input and an output, the amplifier output electrically coupled to the first voice coil;

the first feedback means comprising first circuitry coupling the positional measurement means output with the amplifier input; and the second feedback means comprising a current measurement means electrically coupled with the first voice coil and having an output, and a bandpass filter coupling the current measurement means output with the amplifier input, wherein the speaker further comprises a coil former upon which the first voice coil is wound, and further comprises a second voice coil wound on the coil former, and wherein the first and second voice coils are disposed within a permanent magnetic field, the second voice coil comprising the positional measurement means.

35. A sound reproduction system comprising an amplifier system, a speaker, and first and second negative feedback means;

the speaker having a diaphragm, a first voice coil mechanically coupled with the diaphragm, and positional measurement means coupled with the diaphragm, the positional measurement means having an output;

the amplifier system comprising an amplifier with an input and an output, the amplifier output electrically coupled to the first voice coil;

the first feedback means comprising first circuitry coupling the positional measurement means output with the amplifier input via a low-pass filter; and the second feedback means comprising a current measurement means electrically coupled with the first voice coil and having an output, and a high-pass filter coupling the current measurement means output with the amplifier input, wherein the high-pass filter additionally couples a system input signal with the amplifier input.

36. A sound reproduction system comprising an amplifier system, a speaker, and first and second negative feedback means;

the speaker having a diaphragm, a first voice coil mechanically coupled with the diaphragm, and positional measurement means coupled with the diaphragm, the positional measurement means having an output;

the amplifier system comprising an amplifier with an input and an output, the amplifier output electrically coupled to the first voice coil;

the first feedback means comprising first circuitry coupling the positional measurement means output with the amplifier input via a low-pass filter; and the second feedback means comprising a current measurement means electrically coupled with the first voice coil and having an output, and a high-pass filter coupling the current measurement means output with the amplifier input, wherein the speaker further comprises a coil former upon which the first voice coil is wound, and further comprises a second voice coil wound on the coil former, and wherein the first and second voice coils are disposed within a permanent magnetic field, the second voice coil comprising the positional measurement means.

37. An amplifier system comprising an amplifier and first and second negative feedback means;

the amplifier having an input and an output, the amplifier output adapted for electrical coupling with a speaker voice coil;

the first feedback means comprising first circuitry including a low-pass filter adapted for electrical coupling with a speaker diaphragm positional measurement means; and the second feedback means comprising a current measurement means adapted for electrical coupling with the speaker voice coil and having an output, and a high-pass filter coupling the current measurement means output with the amplifier input, wherein the high-pass filter additionally couples a system input signal with the amplifier input.

38. A sound reproduction system comprising an amplifier system, a speaker, and first and second negative feedback means;

the speaker having a diaphragm, a first voice coil mechanically coupled with the diaphragm, and positional measurement means coupled with the diaphragm, the positional measurement means having an output;

the amplifier system comprising an amplifier with an input and an output, the amplifier output electrically coupled to the first voice coil;

the first feedback means comprising first circuitry coupling the positional measurement means output with the amplifier input; and the second feedback means comprising a current measurement means electrically coupled with the first voice coil and having an output, and a bandpass filter coupling the current measurement means output linearly, within the passband, with the amplifier input.

* * * * *